US005964067A

United States Patent [19]

Lehner et al.

[11] Patent Number: 5,964,067

[45] Date of Patent: Oct. 12, 1999

[54] PREFABRICATED BUILDING ELEMENTS, AND PROCESS FOR PRODUCING THE SAME AND FOR BUILDING WITH THEM

[76] Inventors: Wolfgang Robert Lehner; Annemarie Lehner, both of Feldgasse 1, A-1080 Vienna, Austria

[21] Appl. No.: 08/232,033

[22] PCT Filed: Nov. 6, 1992

[86] PCT No.: PCT/AT92/00142

§ 371 Date: Apr. 25, 1994

§ 102(e) Date: Apr. 25, 1994

[87] PCT Pub. No.: WO93/09308

PCT Pub. Date: May 13, 1993

[30] Foreign Application Priority Data

Nov. 7, 1991 [AT] Austria ..... 2209/91

[51] Int. Cl.[6] ..... E04C 1/39

[52] U.S. Cl. ..... 52/220.2; 52/220.3; 52/220.7; 52/309.9; 52/606; 52/607

[58] Field of Search ..... 52/220.2, 220.3, 52/220.4, 607, 239, 901, 309.9, 220.7, 606

[56] References Cited

U.S. PATENT DOCUMENTS

| | | | |
|---|---|---|---|
| 772,350 | 10/1904 | Fellheimer | 52/220.3 |
| 2,621,027 | 12/1952 | Tatsch | 52/220.3 X |
| 3,173,226 | 3/1965 | Solnick | 52/607 |
| 3,307,312 | 3/1967 | Kreibaum | 52/607 |
| 3,391,507 | 7/1968 | Downing | 52/220.3 X |
| 3,818,656 | 6/1974 | Vigliotti | 52/220.2 X |
| 4,030,259 | 6/1977 | Meckler | 52/220.3 |
| 4,905,428 | 3/1990 | Sykes | 52/239 X |

FOREIGN PATENT DOCUMENTS

| | | | |
|---|---|---|---|
| 0007024 | 6/1990 | WIPO | 52/220.4 |

*Primary Examiner*—Christopher Kent

[57] ABSTRACT

A method and resulting structural building unit wherein a central element has a plurality of channel shaped grooves on at least one side with surface slabs adhesively secured to opposite sides of said central element. Plug-in junction connectors are disposed for alignment and spacing of adjacent ones of said structures by insertion onto said grooves. A heating element is disposed within the channel shaped grooves. The central element has a tongue on one edge and a groove corresponding to the tongue on an opposite edge. At least at one side of said central element, surface slabs may be hingedly fixed. An air-conditioning installation may be disposed within said channel shaped grooves. A process for making structural building units for use in structural engineering wherein in a first step a plurality of channel shaped grooves are disposed on at least one side of the central element. In a second step the rear faces of at least two surface slabs and opposite sides of said central element are pretreated by subsequently disposing coats of adhesive mediator, adhesive bridge and adhesive layer. In a third step said pretreated surface slabs and said opposite sides of said central element are compressed in a low pressure process under influence of heat. Improved phase transitions between even large sized surface slabs being disposed on opposite faces of a central element permit homogenous material reagibility and formstable compound during physical and thermodynamical loads.

8 Claims, 4 Drawing Sheets

FIG. 2A
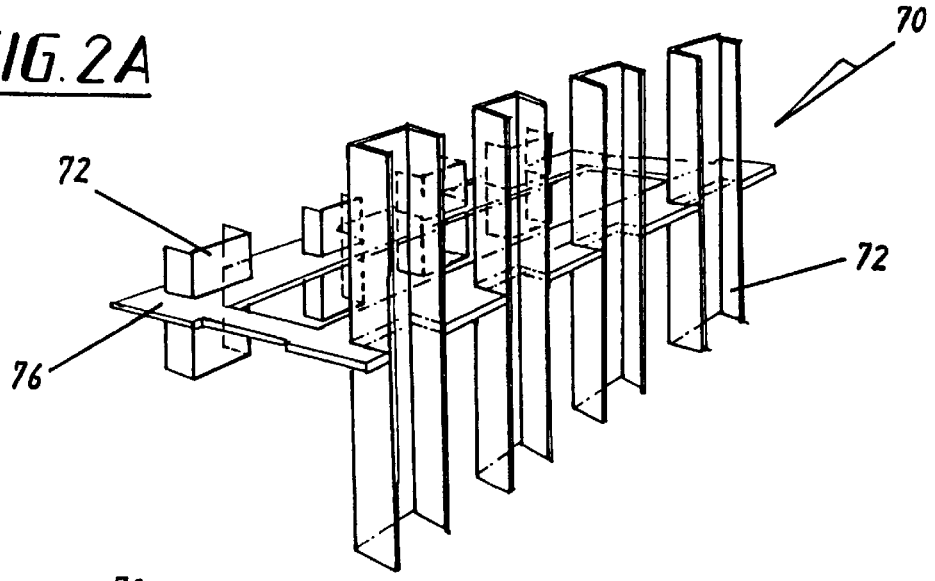
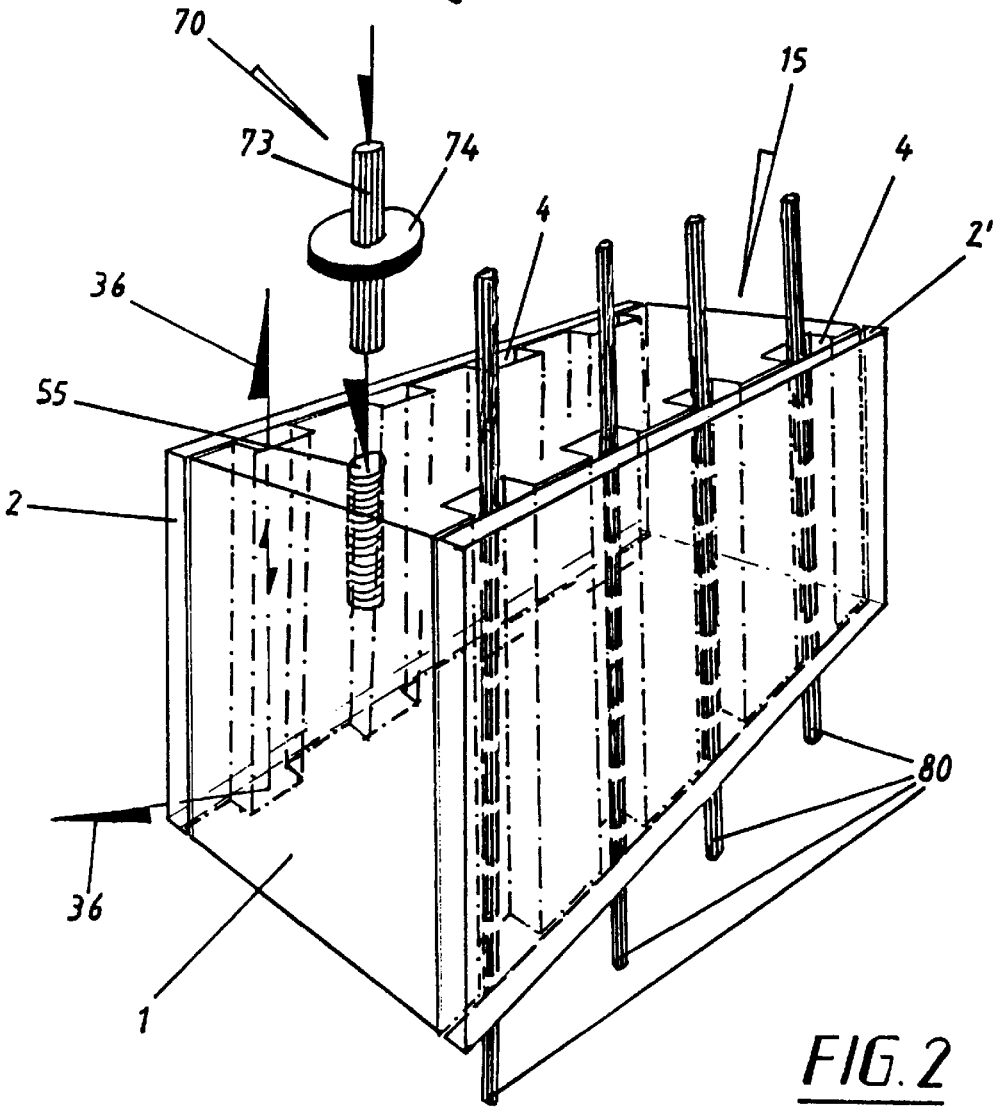
FIG. 2

PREFABRICATED BUILDING ELEMENTS, AND PROCESS FOR PRODUCING THE SAME AND FOR BUILDING WITH THEM

BACKGROUND OF THE INVENTION

1. Field of the Invention

The present invention relates to prefabricated building elements having surface elements applied thereto for use in structural engineering and more particularly for use in constructing roofs, ceilings, floors, walls or the like. The invention further relates to a method for producing structural building units with even large sized surface slabs and high resistance against torsion and vibration loads.

2. Description of the Related Art

Heretofore, building blocks and the like intended to have a finally designing surface have been made by disposing facing slabs onto mortar or a matrix with adhesive layer. For avoidance of condensed moisture and frost damages, building blocks with rear ventilated outer faces are generally known, which are mounted on anchoring constructions provided at raw buildings under high labour and material expense. Building elements are also known having a central portion including channels for utilities and a visible slab hingedly fixed to the central element allowing convenient access to utilities.

Such building elements are subject to the objection that the slabs are not permanently adhered to the blocks by using mortar and can be knocked off in handling, or fall off upon weathering of the mortar. Securing facing slabs to a concrete block by embedding the same in a matrix of polyester resin or the like without providing any rear ventilation may result as vapours fumes during heat influence. Furthermore this method hinders any air transmission so that unhealthy room climate will result when constructing an inside wall. At the opposite sides of a central element no constructive precautions are provided for development of counter forces against torsion- and vibration loads effecting on adhesive joints or other anchoring means between central element and surface slabs. There is the further objection that the anchoring means and the adhesive structure do little, if anything, to build up a durable compound between large sized building elements such as room high elements or ceiling elements with wide span showing large sized surface slabs such as marble slabs or the like. Such elements would be desireable for architectonic planning and reduction of overall building time. The compound of large sized building elements has to be resistant against high pressure-, torsion- and vibration loads dynamically stressing the adhesive joint between central element and surface slabs. During evasive movements of surface slabs and central element these loads effect as destabilizing shearing stresses on adhesive joints. At cracking of adhesive joints, the compound rapidly looses hold and the surface slabs are exposed to splitting up danger.

SUMMARY OF THE INVENTION

The present invention avoids the objections noted above in that the facing material is not only permanently secured to the central element, but the surface structure of the central element and the bonding material used, improve overall building-physics and building biology.

More specially, the present invention relates to a structure and a method to use surface slabs of any size and material, even decorative large sized marble slabs, providing a durable compound, a rear ventilation of surface slabs, heating and air-conditioning function as well.

One of the primary objects of the present invention is to provide improved phase transitions between surface slabs and central elements and homogenous material reagibility against physical and thermodynamical loads effecting upon the material compound.

A still further object of the invention is to provide a structural building unit incorporating the largest possible building-physical, building-biological, constructive, technical, economical and architectural functionalism and to simplify a process for manufactoring the same.

A structural building unit for use in structural engineering, comprises a central element having a plurality of channel shaped grooves on at least one side with finally designing surface slabs adhesively secured to opposite sides of said central element. Plug-in junction connectors are disposed for alignment and spacing of adjacent ones of said structural building units by insertion onto said grooves. A heating element is disposed within the channel shaped grooves. The central element has a tongue on one edge and a groove corresponding to the tongue on an opposite edge.

The arrangement of said channel shaped grooves at opposite sides of the central element and the hence developped surface enlargement not only serves to the rear ventilation of the adhesively secured surface slabs. Also the central element's natural diffusion ability is guaranteed although surface slabs are adhesively secured to opposite sides of the central element. Furthermore, an air layer is developped beneath the surface slabs. As a result development of vapours fumes during heat influence can be avoided.

In a proper feature of the present invention the channel shaped grooves are extending into different directions relatively to each other at opposite sides of the central element. By choice of direction and number of the channel shaped grooves being provided at opposite sides of the central element, physical reaction of the structural building unit against pressure-, torsion- and vibration loads can advantageously be influenced. The inventive structure builds up a strong prestrain. At employment of storey-high wall-elements, or room-wide ceiling-, or roof-elements with wide span, improved stiffness against physical and dynamic loads can easily be achieved. As we found out in vibration- and torsion tests with large sized surface slabs such as natural stone slabs with less than 5 mm thickness adhesively secured to opposite sides of corresponding central elements, pressure-, torsion- and vibration loads cannot destabilize the material compound, if channel shaped grooves are provided in different directions at opposite sides of the central element. The structure according to the present invention rather develops counter forces against effecting loads. High load-moments can be absorbed without any danger of destruction to disposed large sized surface slabs of glass or ceramics.

Integrations of heating elements or air-conditioning installations within the channel shaped grooves result as economic development of low-temperature-heatings directly within the structural building unit. Radiant heat and healthy room climate are proper results. This effect can be supported by employment of temperature storageing surface slabs and dry composition floor. The insertion of U-shaped profiles within the channel shaped grooves serves to improved heating conductivity.

In a feature of the invention a dry composition floor, a heating layer and a surface slab for use in constructing a floor surface are disposed at one side of the central element. A heating layer and a surface slab for use in constructing a ceiling surface are disposed at the opposite side of the central element.

Another feature of the invention is a structural building element, wherein a surface slab for use in constructing a roof surface is disposed at one side of the central element. A heating layers and a surface slabs for use in constructing a ceiling surface are disposed at the opposite side of said central element.

In a still further feature a surface slab for use in constructing a weatherproof outer wall surface is disposed at one side of the central element. A heating layer and a surface slab for use in constructing an inside wall surface are disposed at the opposite side of said central element.

For simplification of manufactoring said structural building units according to the present invention, as well as for development of a durable pressure-, tensile-, torsion- and vibration-firm compound between central element surface slabs, a process for making structural building units for use in structural engineering comprises the following steps: a first step, wherein a plurality of channel shaped grooves is disposed on at least one side of the central element. A second step, wherein the rear faces of at least two surface slabs and opposite sides of said central element are pretreated by subsequently disposing coats of adhesive mediator, adhesive bridge and adhesive layer. A third step, wherein said pretreated surface slabs and said opposite sides of said central element are compressed in a low pressure process under influence of heat. Mutual anchoring of said layers effects by polymerization of said adhesive material with said adhesive bridge at opposite sides of said central element, as well as with said adhesive material at said surface slabs. A fusion of said layer-structure to a physically largely homogeneous material-composite results. Improved phase transitions and formstable compound at an elastic adhesive-joint are achieved by displacement of physical phase bounds between the contact planes of the central element and the surface slabs.

Pressure-, torsion- or vibration stresses are not effecting as loads cracking said material composite. Further counter forces and improved material stiffness are achieved by arrangement of channel shaped grooves differently directed at opposite faces of the central element. Constructively, torsion-stresses lead to increased surface-pressure between central element and surface-slabs. High compactness is the proper result.

As we found out in extreme temperature-change-simulation, vibration- and torsion tests, the structure of the building units according to the invention leads to further building physical advantages like high heat-transmission-resistance. High structural endurance combined with preferably light-weight central elements and light-weight surface slabs opens multiple applications even in the most extreme architectural fields.

Further advantages and details of the present invention will become apparent from the following description and accompanying drawings.

BRIEF DESCRIPTION OF THE DRAWINGS

FIG. 2 illustrates a structural building unit in block shape according to the present invention;

FIG. 2A shows a plug-in junction connector according to the present invention;

DESCRIPTION OF THE PREFERRED EMBODIMENTS

Figure 1:
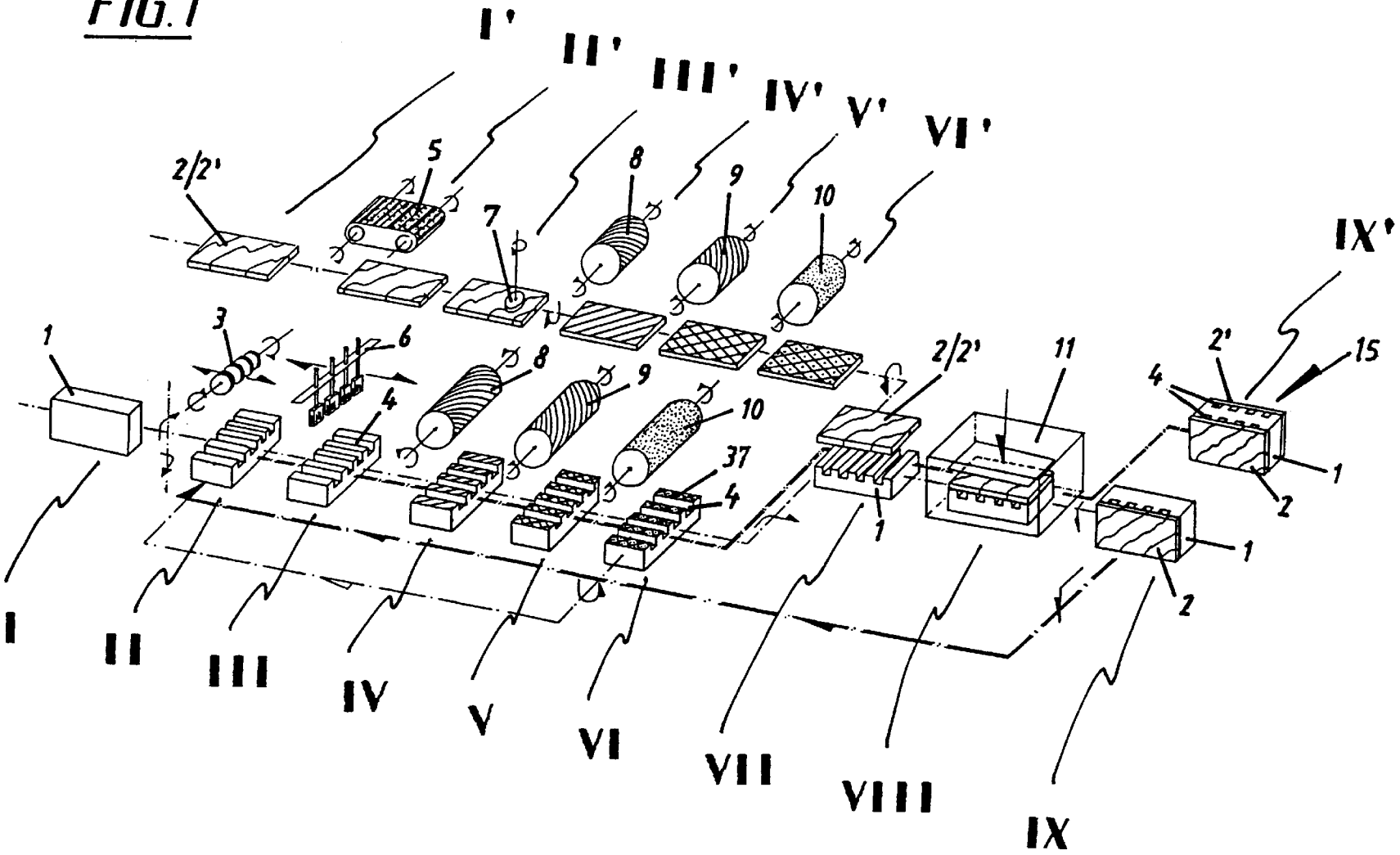
FIG. 1 is a diagram illustrating the successive steps to be used in carrying out a method of making faced structural building units.

Referring now to the drawings, and in particular to FIG. 1 a process for making structural building units for use in structural engineering is illustrated with steps I–IX'. There is proceeded from a central element 1 of any kind and dimension shown in process step I and from surface slabs 2,2' shown in process step I'. Surface slabs 2,2' preferably are of natural stone, artificial stone, glass, metal, clay, concrete or plaster. The choice of said surface slabs 2,2' is orientated on the employment of the structural building unit for constructing roofs, ceilings, floors or walls. For production of light-weight and decorative structural building units 15, prefarably, surface slabs 2,2' of natural stone in thickness less than 5 mm are employed.

In process step II the central element 1 is provided with a number of channel shaped grooves 4 by a shaping device 3 at a first side intended to be covered with a surface slab 2. This procedure is easy to be carried out and regularly leads to exact arrangements of channel shaped grooves 4 in standardized dimensions and distances. Channel shaped grooves 4 may be provided in any direction at opposite sides of the central element 1. Thus, material stiffness can even be locally differentiated.

If sandy central elements 1 are employed, during process step III a coat of diffusible, substance proofing layer 6 can be provided within said channel shaped grooves 4.

For increase of adhesive forces at a first side of said central element 1, which is intended to be covered with said surface slab 2, in process steps IV to VI one after the other an adhesive-mediator 8, an adhesive-bridge 9 and an adhesive-layer 10 are applied at the assembly-plane 37 between said channel shaped grooves 4.

Surface slabs 2,2' of natural stone in process steps II' und III' get grinded by known devices 5,7 and totally surface treated by polishing.

At the gluing plane surface slabs 2,2' are each time pretreated in process steps IV' to VI' by analogy to said steps IV to VI. That way, phase-borders at the gluing-joints between said central element 1 and said surface slabs 2,2' are largely neutralized in favour of improved compound forces.

In process step VII said pretreated first surface slab 2 is adhesively secured to a first side of said central element 1 by employment of polymerizing adhesives 10. In process step VIII this composite is compressed by a low pressure device 11 under heat influence.

Departing now from process step IX, in which a first side of the central element 1 is durably connected with a surface slab 2, said process steps II to VIII are repeated at an opposite side of the central element 1. In a variant, process steps II to VI can also be carried out one after the other, or at the same time, before executing step VII at opposite sides of the central element 1. At process step IX' there exists a structural building unit 15 with surface slabs 2,2' adhesively secured to opposite sides of the central element 1 as best illustrated in FIG. 2.

For arrangement of a heating-layer 40 beneath said surface slab 2' said process steps IV' to VI' and VII to IX are provided by analogy. Subsequently, as already mentioned to said process steps IV' to VI' and IV to VIII, by analogy, a temperature storageing surface slab 2' is mounted upon said heating-layer 40. In a variant, surface slabs 2' provided with integrated heating wires at their rearsides may be employed.

At employment of a central element 1 of gas-concrete and of surface slabs 2,2' of natural stone, and after having applied said adhesive-mediator 8, said adhesive-bridge 9 and said adhesive-layer 10, a homogeneously reactive composite results effecting on the similarity of the incorporated mineral components limestone and quartz sand.

In a preferred embodiment channel shaped grooves 4 are arranged in a way, that the assembly planes 37 existing between said grooves 4 each time only amount at most 50% of each side of the central element 1. The depth of said channel shaped grooves 4 amounts at least 50% of said assembly planes' 37 width. By way of this surface enlargement on opposite sides of said central element 1, diffusion behaviour can advantageously be influenced. Thus, the central element's 1 initial diffusibility can easily be maintained although surface slabs 2,2' are adhesively secured to opposite sides of the central element 1. A temperature-proof-behaviour nearly without transmission-heat-losses is one proper result.

FIG. 2 illustrates a structural building unit 15 comprising a central element 1 having a plurality of channel shaped grooves 4 on at least one side with surface slabs 2,2' adhesively secured to opposite sides of said central element 1. Heating elements 80 for water-heating, electric heating, warm air-heating or the like are disposed within the channel shaped grooves 4. The surface slab 2' is a decorative natural- or artificial stone slab being suited for temperature storage.

FIG. 2A illustrates a plug-in junction connector 70 for alignment and spacing of adjacent structural building units 15 by insertion onto the channel shaped grooves 4, comprising a spacer-frame 76 and U-shaped profiles 72 with the opening directed to the surface slabs 2,2'. The arrangement of U-shaped profiles 72 guarantees protection against entering of adhesives or mortar into said channel shaped grooves 4 during building construction. In the area of each spacer-frame 76 unhindered ventilation flow 36 effects within the channel shaped grooves 4.

As illustrated in the upper part of FIG. 2, for alignment and spacing of adjacent structural building units 15, in a variant of plug-in junction connectors 70, bolts 73 with spacers 74 may be employed, which as are inserted onto corresponding holes 55 within the central element 1.

Figure 3:
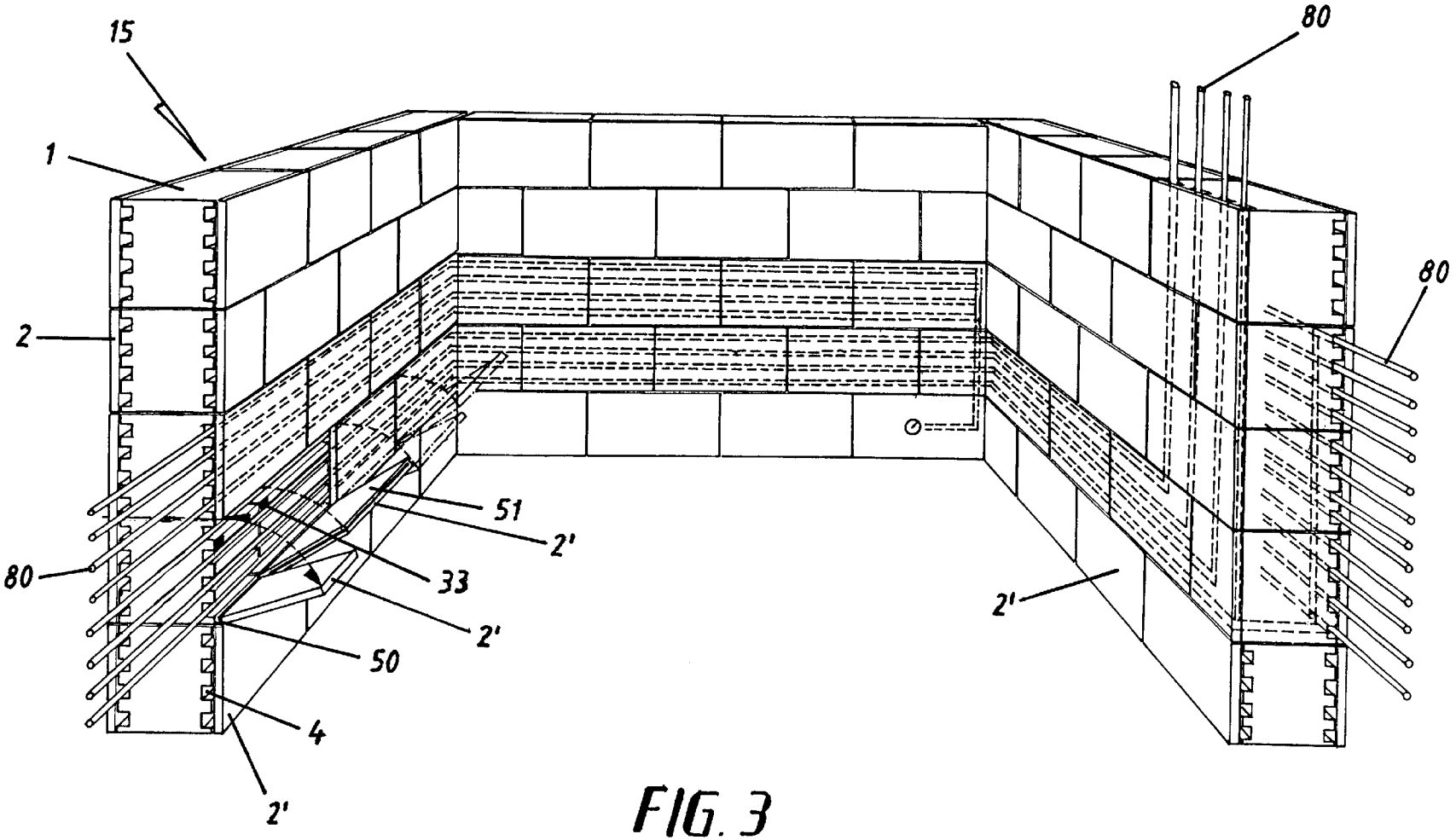
FIG. 3 illustrates a wall built of structural building units according to the present invention.

Referring now particularly to FIG. 3, heating elements 80 for water-heating, electric heating, warm air heating or the like are disposed within the channel shaped grooves 4. Surface slabs 2' are of decorative natural- or artificial stone or ceramics suited for temperature storage. For benefits of operation and service of said heating elements 80, in a further embodiment surface slabs 2' are hingedly fixed on said central element 1 by a known hinge 50. For improved heat conductivity the rearside of said hingedly fixed surface slab 2' may be connected with an additional metal slab 51 and a magnet 33 for connection with said central element 1. The positions of said integrated heating elements 80 are variable, corresponding to the directions of said channel shaped grooves 4 in parallel or diverging from each other.

Figure 4:
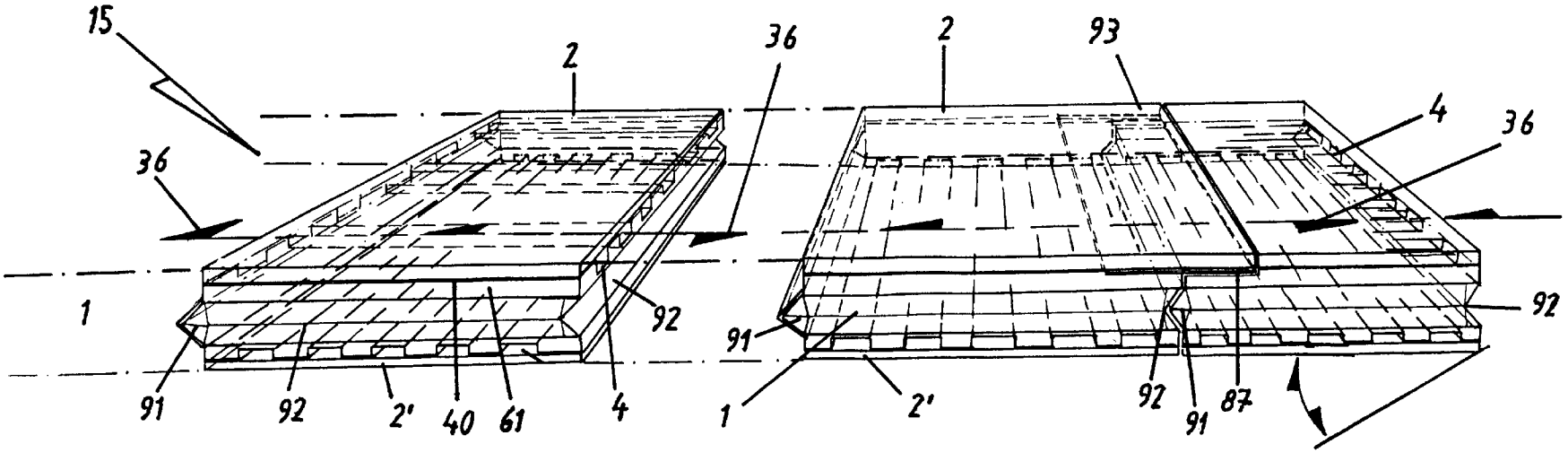
FIG. 4 shows roof-ceiling elements according to the present invention.

In a further embodiment, FIG. 4 illustrates structural building units 15 for constructing roofs and ceilings. Central elements 1 have a tongue 91 on one edge and a groove 92 corresponding to the tongue 91 on an opposite edge. A surface slab 2 for use in constructing a roof surface is disposed at one side of the central element 1. A surface slab 2' for use in constructing a ceiling surface, a plaster paste-board slab or the like is disposed at the opposite side of said central element 1. Heating elements 80 are disposed within the channel shaped grooves 4. The ventilation flow 36 develops a known cold-roof-effect. The upper surface slab 2 overtops the central element 1 at least at one edge, whereby a corresponding material graduation 87 of an adjoining structural building unit 15 is surface flushingly overlapped by said overtopping part 93. These structural building units 15 are mounted on rising brickwork 82 or on roof framework 88 in residential-ready condition.

While preferred embodiments of the present invention have been illustrated and described, it will be understood to those skilled in the art that changes and modifications may be made therein without departing from the invention in its broader aspets.

We claim:

1. A structural building unit for use in structural engineering, comprising: a central element having a plurality of channel shaped grooves on at least one side with surface slabs adhesively secured to opposite sides of said central element; plug-in junction connectors for alignment and spacing of adjacent ones of said central elements by insertion into said grooves; a heating element disposed within the channel shaped grooves; U-shaped profiles within the channel shaped grooves; and wherein the central element has a tongue on one edge and a groove corresponding to the tongue on an opposite edge.

2. A structural building unit as defined in claim 1, wherein air-conditioning installations are disposed within the channel shaped grooves.

3. A structural building unit as defined in claim 1, wherein the U-shaped profiles within the channel shaped grooves are overtopping the channel shaped grooves for developing plug-in junction connectors for alignment and spacing of adjacent structural building units.

4. A structural building unit as defined in claim 1, wherein the channel shaped grooves are extending into different directions relatively to each other at said opposite sides of the central element.

5. A structural building unit as defined in claim 1, wherein a dry composition floor; a heating layer and a surface slab for use in constructing a floor surface are disposed at one side of the central element; a heating layer and a surface slab for use in constructing a ceiling surface are disposed at the opposite side of said central element.

6. A structural building unit as defined in claim 1, wherein a surface slab for use in constructing a roof surface is disposed at one side of the central element; a heating layer and a surface slab for use in constructing a ceiling surface are disposed at the opposite side of said central element.

7. A structural building unit as defined in claim 1, wherein a surface slab for use in constructing an outer wall surface is disposed at one side of the central element; a heating layer and a surface slab for use in constructing an inside wall surface are disposed at the opposite side of said central element.

8. A structural building unit for use in structural engineering, comprising: a central element having a plurality of channel shaped grooves on at least one side with surface slabs disposed at opposite sides of said central element wherein at least one surface slab is hingedly fixed at said central element; plug-in junction connectors for alignment and spacing of adjacent ones of said central elements by insertion into said grooves; a heating element disposed within the channel shaped grooves; U-shaped profiles within the channel shaped grooves; and wherein the central element has a tongue on one edge and a groove corresponding to the tongue on an opposite edge.

* * * * *